United States Patent [19]

Scripnick

[11] Patent Number: 4,998,836

[45] Date of Patent: Mar. 12, 1991

[54] VENTURI LINE OPERATED SOAP BRUSH

[76] Inventor: Mark Scripnick, 401 Mountjoy South, Timmins, Ontario, Canada, P4N 1V4

[21] Appl. No.: 344,661

[22] Filed: Apr. 28, 1989

[51] Int. Cl.[5] ..... A46B 11/06

[52] U.S. Cl. ..... 401/42; 137/878; 401/46; 239/310; 239/588

[58] Field of Search ..... 239/317, 318, 310, 445, 239/574, 588; 401/40, 42, 43, 44–46, 289; 137/878

[56] References Cited

U.S. PATENT DOCUMENTS

| | | | |
|---|---|---|---|
| 2,588,255 | 3/1952 | Larsh | 239/318 X |
| 3,637,143 | 1/1972 | Shames | 239/283 |
| 3,763,888 | 10/1973 | Daecker | 239/318 |
| 3,875,604 | 4/1975 | Wurn | 15/21 R |
| 3,910,265 | 10/1975 | Coleman | 401/43 |
| 4,417,826 | 11/1983 | Floros | 401/42 |

FOREIGN PATENT DOCUMENTS

| | | | |
|---|---|---|---|
| 87613 | 10/1959 | Denmark | 401/46 |
| 292098 | 7/1965 | Netherlands | 401/46 |

*Primary Examiner*—Richard J. Johnson

[57] ABSTRACT

The present invention provides a shower brush and liquid soap dispenser combination for use in a shower. The soap dispenser has an inlet end which is connectable to the main water supply of the shower and an outlet end which is connectable to the brush. The inlet end of the dispenser includes a venturi feed to a liquid soap container in the dispenser such that water flowing through the water supply and into the soap dispenser draws liquid soap by suction through the venturi feed from the liquid soap container. The liquid soap is mixed with the water to form a soap and water mixture which is then fed by the water supply through the dispenser to the brush.

4 Claims, 4 Drawing Sheets

VENTURI LINE OPERATED SOAP BRUSH

FIELD OF THE INVENTION

The present invention provides a shower brush which has an automatic soap feed through the shower brush.

BACKGROUND OF THE INVENTION

In taking a shower people often make use of a sponge or brush, particularly when trying to wash ones back where the brush has a relatively long reach making the back area more accessible. However, the typical way of applying soap to the brush is by simply applying the soap to the brush bristles as by rubbing a solid bar of soap or squeezing liquid soap onto the brush bristles. This necessitates repeated application of the soap to the brush where the soap is quickly washed from the bristles by the shower water.

SUMMARY OF THE PRESENT INVENTION

The present invention provides a combination shower brush and liquid soap dispenser for use in a shower for overcoming the problems described above. In particular, the dispenser includes an inlet end connectable to a water supply of the shower and an outlet end connectable to the brush. The inlet end of the dispenser has a venturi feed from a liquid soap container within the dispenser and operates in a manner whereby water flowing through the water supply and into the dispenser draws liquid soap by suction or reduced pressure through the venturi feed from the liquid soap container. The liquid soap is then mixed with the water to form a soap and water mixture which is fed by the water supply through the dispenser to the brush.

With the combination as described above, there is no need for the separate hand application of the soap to the brush and furthermore, since the liquid soap itself forms part of the mixture, it comes through rather than washing off of the brush with use of the shower.

According to an aspect of the present invention, the brush is provided with means to shut off the soap dispensing and use the brush in a rinse mode only.

BRIEF DESCRIPTION OF THE DRAWINGS

The above as well as other advantages and features of the present invention will be described in greater detail according to the preferred embodiments of the present invention in which.

DETAILED DESCRIPTION ACCORDING TO THE PREFERRED EMBODIMENTS OF THE PRESENT INVENTION

Figure 1:
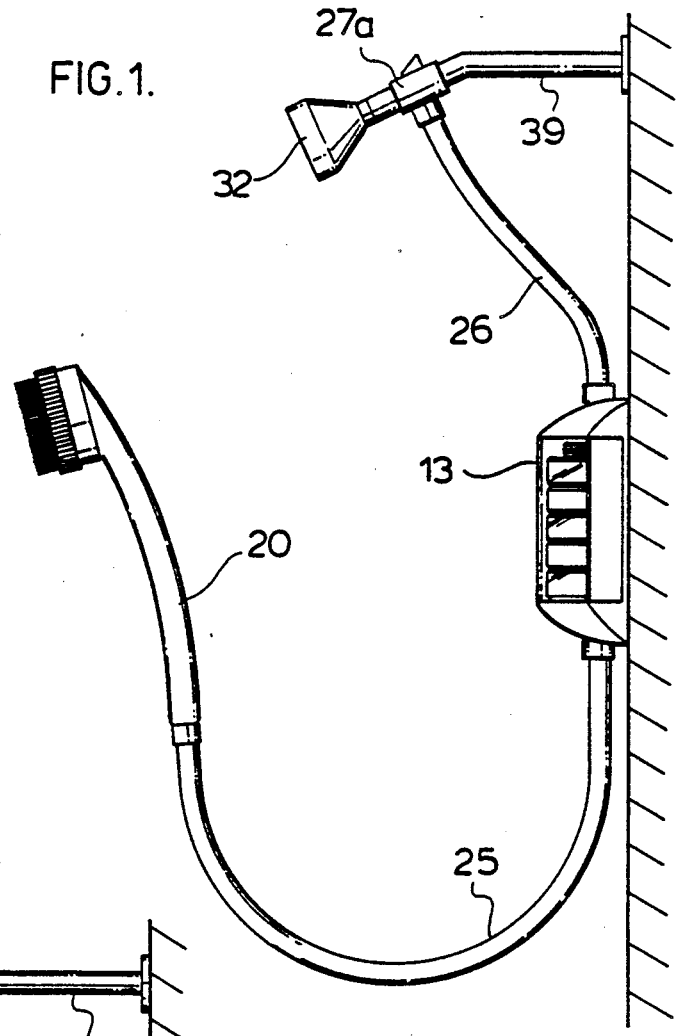
FIG. 1 is a schematic view of a shower set up including a brush and soap dispenser in accordance with a preferred embodiment of the present invention.

The general set up shown in FIG. 1 of the drawings comprises a standard shower arm 39 providing the main water supply to a shower stall and a standard shower head 32. Fitted between the shower head and the shower arm is a diverter valve 27*a* to which is connected a short length of hose 26. This hose extends down to a wall mounted soap dispensing unit generally indicated at 13. Extending from the soap dispensing unit is a further longer hose section 25 which goes to a shower brush 20. The shower brush can either be used in a wash mode where it picks up a soap/water mixture from the soap dispensing unit or in a rinse mode where water only passes through the shower brush.

Figure 3:
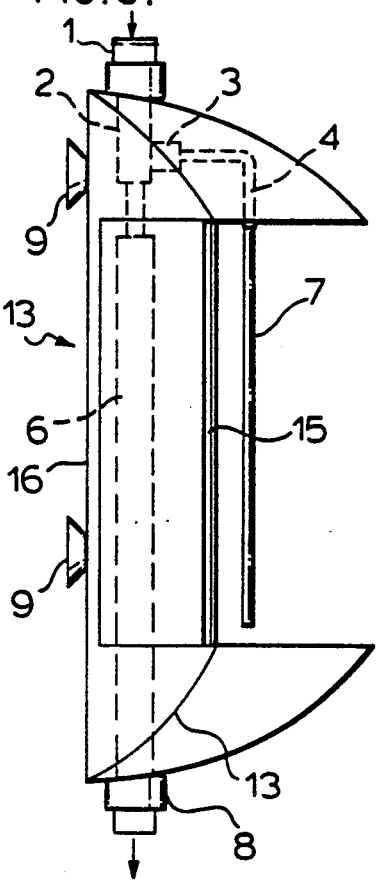
FIG. 3 is a side sectional view through the soap dispenser of FIG. 1.

FIG. 3 shows in detail the features of the soap dispensing unit which includes an inlet end 1 and an outlet end 8. Hose 26 is fitted at one end to coupling 30 of diverter 27*a* and at the other end to the inlet 1 of the soap dispensing unit. Hose 25 is fitted at one end to the outlet end 8 of the soap dispensing unit and at its other end to brush 20.

The soap dispensing unit may be mounted in the shower stall unit in various different manners. According to the embodiment shown, the unit includes rear suction cups 9 to hold the unit in position. It is further provided with key-shaped openings 17 in the back plate 16 of the unit which can be used in a more permanent type of set up to fit over mounting screws or the like. A combination of mounting screws and suction cups provides a very secure mounting of the unit to the shower stall wall.

Figure 3A:
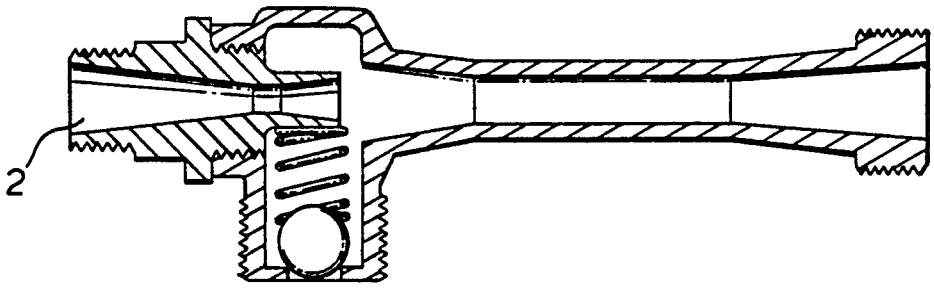
FIG. 3*a* is a sectional view through the venturi feed from the soap dispenser of FIG. 3.
Figure 5:
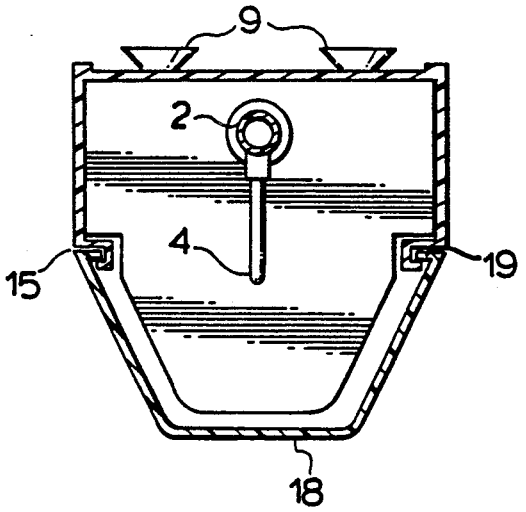
FIG. 5 is a top view of the soap dispenser shown in FIG. 1.
Figure 6:
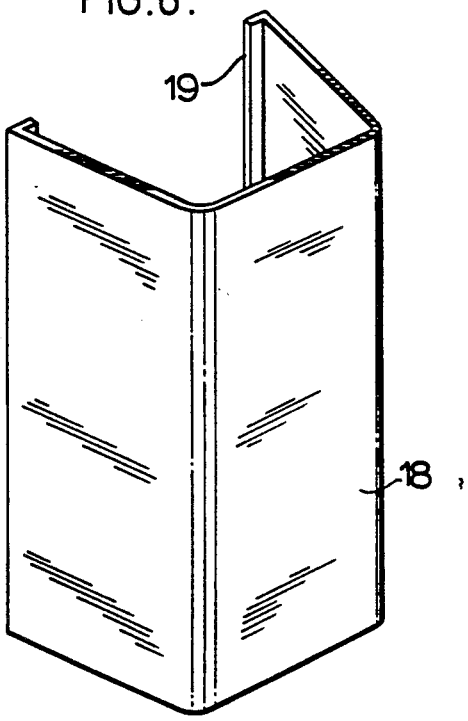
FIG. 6 is a perspective view of the front panel used to close the soap dispenser of FIG. 3.
Figure 7:
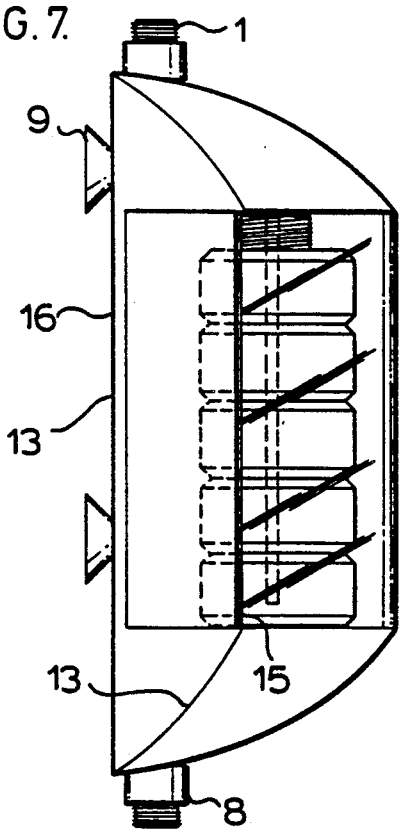
FIG. 7 is a side view of the soap dispenser of FIG. 1 with a soap bottle fitted in the soap dispenser.
Figure 8:
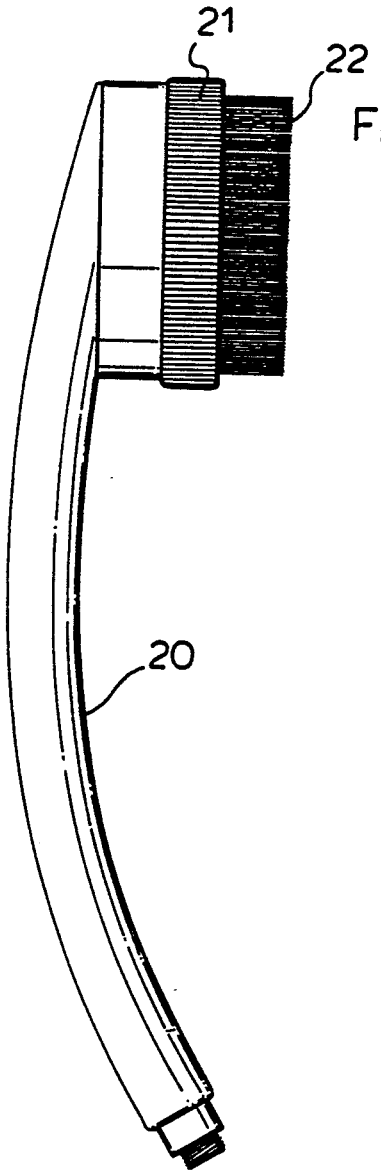
FIG. 8 shows is a side view of the shower brush from the set up of FIG. 1.
Figure 9:
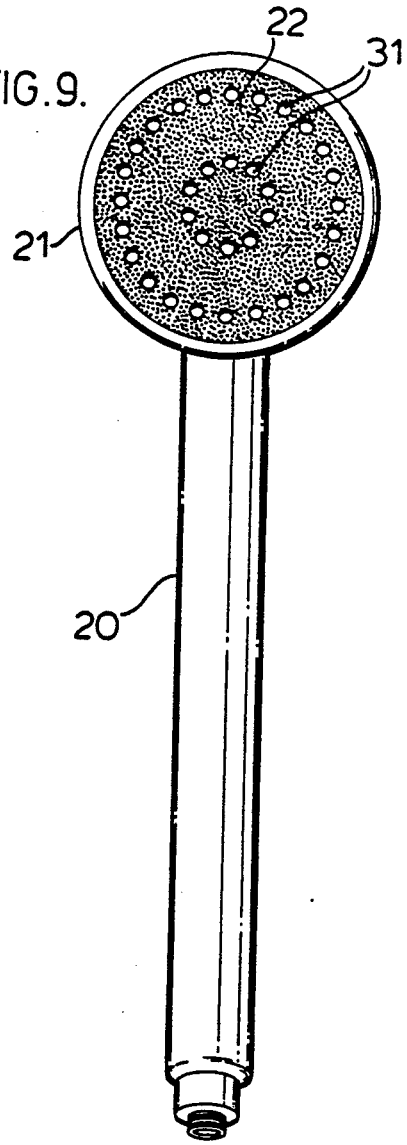
FIG. 9 is a front view of the shower brush of FIG. 10.
Figure 10:
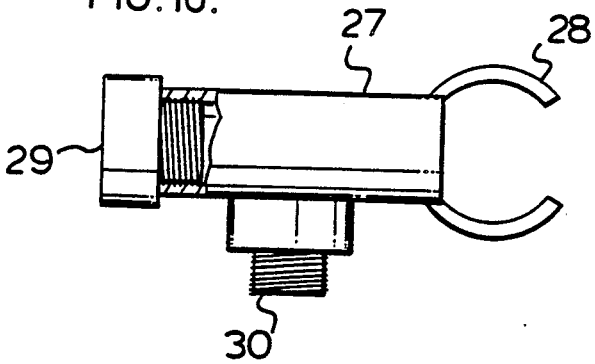
FIG. 10 shows a hose coupler used in the set up of FIG. 2.

Provided internally of the water supply through dispenser unit 13 is a venturi 2, the details of which are seen in FIG. 3*a* of the drawings. This venturi operates in a standard manner whereby the water flowing under pressure enters the unit through hose 26 and passes down through venturi 2. When the water is at a relatively high pressure from the main water supply it creates a high speed low pressure region within the venturi providing a suction which operates directly on a check valve 3 feeding off of the venturi. This check valve then extends to a siphoning tube 4 having a flexible extension 7 which fits directly into a liquid soap container 24 fitted in unit 13. This liquid soap container is seen in FIG. 7 of the drawings and is of the standard store purchased variety. Unit 13 includes a removable front panel 18 as seen in FIG. 6 of the drawings which allows the soap container to be fitted into the unit which the siphoning tube in position as seen in FIG. 7. The front panel which includes a side lip 19 simply slides down into mounting troughs 15 of the unit as seen in FIG. 5 of the drawings to provide a finished or completed look to the unit when it is ready to be operated.

Figure 4:
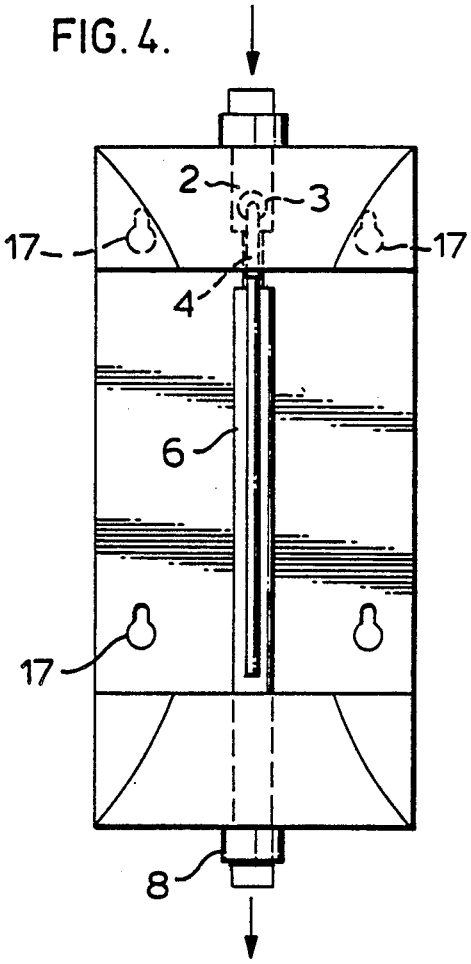
FIG. 4 is a front view of the soap dispenser of FIG. 3.

Returning to FIGS. 3 and 4 of the drawings, the water supply continues at discharge tube 6 from the venturi to the outlet end of the dispenser and through hose 25 to brush 20.

In the set up of FIG. 1, diverter valve 27*a* can be set to either direct the water downwardly through hose 26 to soap dispenser 13 or to have the water flow directly out through shower head 32 or even to have a combination flow through shower head 32 and through hose 26 to the soap dispensing unit. When the diverter valve is set such that there is at least some water flowing to the soap dispensing unit, this water passes down through venturi 2 and as described above creates a suction at check valve 3. Check valve 3 is set at a pressure such that a preset flow rate must be passing through the venturi to open the check valve otherwise the check valve remains closes with no soap being drawn from the liquid soap container. The flow rate through the venturi can be controlled in a number of different manners one of which is by simply setting the diverter whereby only a relatively small amount of water passes down through hose 26 keeping the check valve closed. In a further embodiment of the present invention brush 20 is provided with a flow adjustment ring 21. This flow adjustment ring is settable between a wash position where liquid soap is drawn from the soap dispenser and a rinse position where water only flow through the brush. The front of the brush includes water orifices 31 at the brush bristles 22 and when the ring is set in the wash position, these orifices 31 are completely open for maximum water flow through the brush which then creates a high speed low pressure water flow within venturi 2 opening check valve 3 and drawing the liquid soap from the liquid soap container. This liquid soap is mixed with the water and passes through orifices 31 onto the brush bristles as a soap/water mixture.

When ring 21 is rotated or adjusted to the rinse mode orifices 31 are partially closed off reducing the amount of water flow through the brush which in turn restricts water flow through the venturi 2 to the point that there is not a sufficient pressure reduction to open check valve 3. Therefore, in the rinse setting there is no soap mixed with the water which passes through the brush.

Figure 2:
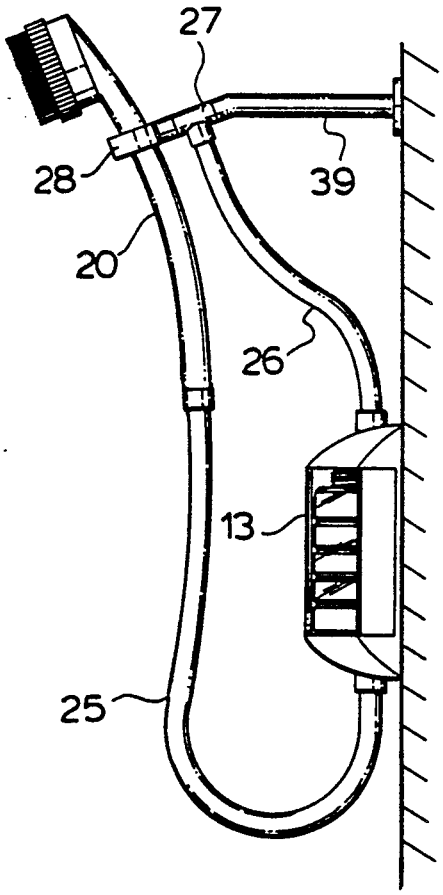
FIG. 2 is a further schematic view showing an alternate set up from that shown in FIG. 1.

FIG. 2 shows a somewhat different set up from that shown in FIG. 1 where the brush itself can be used as a shower head. In this set up coupler 27, as shown in FIG. 12 of the drawings, is fitted at its end 29 directly to shower arm 39. Hose 29 is then connected at 30 to the coupler 27. The coupler further includes a C-clamp 28 for holding the brush as shown in FIG. 2 of the drawings where the brush is used as the actual shower head. However, the brush can also be snapped out of the coupler and used as a brush which again includes the flow adjustment ring so the brush can be set to either the rinse or the wash mode.

It will now be appreciated from the description above how a simple yet very efficient set up is provided in accordance with the present invention including a soap dispensing brush which does not require the use of separate soap bars or the like for soap to be applied to the brush. Furthermore, although various preferred embodiments of the invention have been described in detail, it will be appreciated by those skilled in the art that variations may be made without departing from the spirit of the invention or the scope of the appended claims.

The embodiments of the invention in which an exclusive property or privilege is claimed are defined as follows:

1. A shower stall arrangement comprising a shower stall wall, a standard threaded shower arm, a liquid soap dispenser mounted to said shower stall wall, a connector member on said shower arm, a first hose from said connector member to said liquid soap dispenser, a wash brush, and a second hose from said liquid soap dispenser to said wash brush, said connector member being threadably secured without permanent modification to said shower arm, said liquid soap dispenser having a venturi feed including a valve which is responsive to a preset water flow rate for operation of said valve and venturi feed, the arrangement being such that water flowing through said first hose to said dispenser at and above said predetermined flow rate opens said valve to operate said venturi and draw liquid soap from said dispenser to form a soap and water mixture which is fed through said second hose to said wash brush, said valve in said venturi feed remaining closed when the water flowing through said dispenser is below said predetermined rate to provide water only to said brush.

2. An arrangement as claimed in claim 1 including a shower head and wherein said connector comprises a diverter valve located between said shower head and said shower arm, said diverter valve being settable to direct water flow to said dispenser and brush or to said shower head.

3. An arrangement as claimed in claim 1, wherein said connector includes a brush mount for removably securing said brush in a shower head position to said shower arm.

4. An arrangement as claimed in claim 1, wherein sid liquid soap dispenser includes suction cups removably mounting said dispenser to said shower stall wall.

* * * * *